United States Patent [19]

Miyakawa et al.

[11] Patent Number: 4,607,936

[45] Date of Patent: Aug. 26, 1986

[54] ELECTROPHOTOGRAPHIC APPARATUS COMPRISING PHOTOSENSITIVE LAYER OF AMORPHOUS SILICON TYPE PHOTOCONDUCTOR

[75] Inventors: Nobuhiro Miyakawa, Abiko; Teruaki Higashiguchi, Tokyo; Koji Yano, Tokyo; Kazuo Yamamoto, Tokyo; Yoshinobu Kawakami, Tokyo, all of Japan

[73] Assignee: Mita Industrial Co., Ltd., Osaka, Japan

[21] Appl. No.: 655,533

[22] Filed: Sep. 28, 1984

[30] Foreign Application Priority Data

| | | | |
|---|---|---|---|
| Sep. 30, 1983 | [JP] | Japan | 58-180738 |
| Oct. 31, 1983 | [JP] | Japan | 58-202825 |
| Nov. 11, 1983 | [JP] | Japan | 58-173692[U] |
| Nov. 30, 1983 | [JP] | Japan | 58-183770[U] |

[51] Int. Cl.[4] ..... G03G 15/12

[52] U.S. Cl. ..... 355/3 DR; 355/3 R; 355/14 R; 219/216

[58] Field of Search ..... 355/3 DR, 3 R, 30, 14 R; 219/216; 432/228

[56] References Cited

U.S. PATENT DOCUMENTS

| | | | |
|---|---|---|---|
| 4,161,357 | 7/1979 | Herman et al. | 355/3 DR |
| 4,299,474 | 11/1981 | Ernst et al. | 355/3 DR |
| 4,319,828 | 3/1982 | Komori et al. | 355/3 DR X |
| 4,344,700 | 8/1982 | Kasama et al. | 355/3 DR X |
| 4,484,809 | 11/1984 | Coleman | 355/3 DR |

*Primary Examiner*—A. C. Prescott

*Attorney, Agent, or Firm*—Sherman and Shalloway

[57] ABSTRACT

Disclosed is an electrophotographic apparatus comprising a photosensitive drum comprising an amorphous silicon type photoconductor layer formed on an electroconductive substrate, a main charging mechanism for charging the surface of the drum with charges having a predetermined polarity, an imagewise exposure mechanism for forming an electrostatic image corresponding to an image of an original on the surface of the drum, a toner development mechanism for forming a toner image corresponding to the electrostatic image, a toner image transfer mechanism for transferring the toner image formed on the surface of the photosensitive drum to a predetermined paper sheet, a toner cleaning mechanism for removing the residual toner adhering to the surface of the photosensitive drum and a fixing mechanism for fixing the transferred toner image to said paper sheet, wherein a heating mechanism is arranged to heat the surface of the photosensitive drum at a temperature of 30° to 40° C.

The problem of the flow of an image inherent to the use of an amorphous silicon type photoconductive layer is effectively solved if this electrophotographic apparatus is employed.

16 Claims, 14 Drawing Figures

ELECTROPHOTOGRAPHIC APPARATUS COMPRISING PHOTOSENSITIVE LAYER OF AMORPHOUS SILICON TYPE PHOTOCONDUCTOR

BACKGROUND OF THE INVENTION (1) Field of the Invention

The present invention relates to an electrophotographic apparatus comprising a photosensitive layer of an amorphous silicon type photoconductor. More particularly, the present invention relates to an electrophotographic, apparatus in which the problem of the flow of an image, which is inherent to the use of an amorphous silicon type photoconductor, is effectively solved.

(2) Description of the Prior Art

A layer of an amorphous silicon type photoconductor has a high surface hardness and a good sensitivity to rays having a long wavelength. Accordingly, this photoconductor layer has attracted attention as a photosensitive material for electrophotography.

However, in an electrophotographic apparatus comprising a layer of this amorphous silicon type photoconductor, when this photosensitive layer is used repeatedly, the surface of the photosensitive material becomes sensitive to moisture and is likely to absorb water therein, with the result that the surface resistivity is reduced and surface charges migrate in the lateral direction, and the so-called flow of an image is caused.

As means for preventing this undesirable phenomenon of the flow of an image, there has been proposed a method in which a blocking layer of a-$Si_x.C_{1-x}$ or a-$SiN_x$ is formed on the surface of the photosensitive material. However, even if this surface treatment is performed on the surface of the photosensitive material, it is impossible to completely prevent occurrence of the flow of an image.

SUMMARY OF THE INVENTION

We found that in an electrophotographic process using an amorphous silicon type photoconductor as an electrophotographic photosensitive material, when the operations of charging, imagewise exposure and transfer are carried out while maintaining the temperature of the surface of the photosensitive material, that is, the surface of the amorphous silicon type photoconductor, at 30° to 40° C., occurrence of the above-mentioned undesirable phenomenon of the flow of an image is effectively prevented. We have now completed the present invention based on this finding.

It is therefore a primary object of the present invention to provide an electrophotographic apparatus comprising a layer of an amorphous silicon type photoconductor as a photosensitive layer, in which the problem of the flow of an image is effectively solved.

In accordance with the present invention, there is provided an electrophotographic apparatus comprising a photosensitive drum comprising an amorphous silicon type photoconductor layer formed on an electroconductive substrate, a main charging mechanism for charging the surface of the drum with charges having a predetermined polarity, an imagewise exposure mechanism for forming an electrostatic image corresponding to an image of an original on the surface of the drum, a toner development mechanism for forming a toner image corresponding to the electrostatic image, a toner image transfer mechanism for transferring the toner image formed on the surface of the photosenitive drum to a predetermined paper sheet, a toner cleaning mechanism for removing the residual toner adhering to the surface of the photosensitive drum and a fixing mechanism for fixing the transferred toner image to said paper sheet, wherein a heating mechanism is arranged to heat the surface of the photosensitive drum at a temperature of 30° to 40° C.

BRIEF DESCRIPTION OF THE DRAWINGS

FIG. 4-B is a sectional view showing the flange portion in the embodiment shown in FIG. 4-A.

DETAILED DESCRIPTION OF THE PREFERRED EMBODIMENTS

Figure 1:
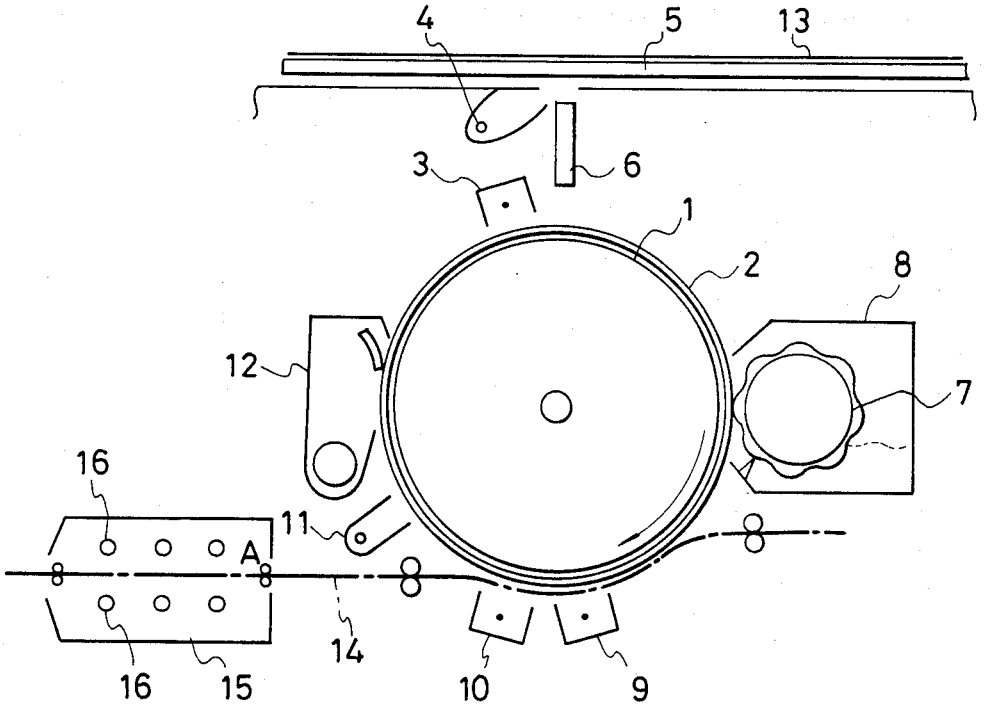
FIG. 1 is a diagram illustrating the entire structure of a copying machine to which the present invention is applied.

As pointed out hereinbefore, when an amorphous silicon type photoconductor layer is used repeatedly, the surface of the photosensitive material becomes sensitive to moisture and is likely to adsorb water therein, with the result that the surface charges leak in the lateral direction to render formation of an electrostatic latent image impossible and the flow of an image is caused. We made research on this undesirable phenomenon of the flow of an image, and we presumed that when the amorphous silicon photoconductive layer is used repeatedly, the flow of an image would be caused by a change of the intermolecular bond of silicon, which is caused by the exposure of the surface of the amorphous silicon photoconductive layer to the corona discharge.

More specifically, when an amorphous silicon type photosensitive material ordinarily used for an electrostatic copying apparatus is subjected to glow discharge, the long range order accumulated on the base is lost, and the amorphous silicon type photosensitive material is constructed by interatomic bonds of silicon where only the short range order is present and therefore, many dangling bonds are present. Since the local level density is increased by the presence of the dangling bonds, these dangling bonds are ordinarily blocked with hydrogen atoms, and they are made present in the form of amorphous silicon hydride (a—Si:H) to readily cause a doping effect with a dopant such as boron or phosphorus.

As a photosensitive layer of this amorphous silicon hydride is repeatedly used in a known electrophotographic process, the photosensitive layer is exposed to corona discharge at such steps as charging and transfer, and hydrogen atoms are released and dangling bonds are formed again. This dangling bond of silicon is attacked by ozone generated by corona discharge and a silicon-oxygen bond, such as Si—OH or Si—O—Si, which is more stable than the Si—H bond, is formed. Since this oxygen atom present on the surface of the photosensitive layer is hydrophilic, if the concentration of the silicon-oxygen bond is increased with increase of the frequency of the exposure to corona discharge, molecules of water in the atmosphere surrounding the surface of the photosensitive layer are readily absorbed in the photosensitive laye and the photosensitive material becomes sensitive to moisture. It is considered that this is the cause of the undesirable phenomenon of the flow of an image.

The above consideration is supported by the fact that when the surface of the photosensitive layer where the flow of an image takes place is analyzed by XPS (X-ray photoelectron spectroscopy), the Si—O bond is detected or if the front layer where the Si—O bond is formed is thinly peeled from the photosensitive layer where the flow of an image takes place by plasma etching, the flow of an image is not caused any more.

We judge that the phenomenon of adsorption of water molecules in the atmosphere by the oxygen atom bonded to silicon (hereinafter referred to as "water molecule adsorbing medium"), which is considered to be the cause of the low of an image, is substantially different from the dewing phenomenon caused when a conventional Se type photosensitive material is used. The reasons are described below.

When the operation of a copying machine is stopped and the copying machine is allowed to stand still, as the temperature in the machine is lowered, the temperature of the photosensitive drum having a specific heat smaller than air is lowered more rapidly than the temperature of the atmosphere surrounding the drum and therefore, the water vapor pressure in the vicinity of the surface of the photosensitive drum becomes the saturated vapor pressure and the dewing phenomenon is caused. Accordingly, occurrence of the dewing phenomenon is prevented, as disclosed in, for example, Japanese Patent Application Laid-Open Specification No. 53376/80, by a method in which a dewing-preventing heater is attached to a copying machine and the temperature is maintained at a level not causing crystallization of the Se type photosensitive material, for example, at up to 30° C., so that the temperature of the surface of the photosensitive material is not lowered to the dew point. Namely, the dewing phenomenon is not caused during the copying operation but is caused when the copying machine is used for the first time in the morning after the copying machine has been allowed to stand still in the night.

In contrast, the phenomenon of the flow of an image is caused even while the copying operation is continued. As pointed out hereinbefore, this phenomenon is caused by the adsorption of water molecules in the atmosphere in the vicinity of the surface of the photosensitive layer by the water molecule absorbing medium having Si—O bonds generated on the surface of the photosensitive layer by exposure to corona discharge. This adsorption of water molecules is caused relatively to the relation between the densities of the water molecule and the water molecule adsorbing medium, even if the water vapor pressure is lower than the saturated water vapor pressure.

In order to prevent occurrence of the flow of an image, described hereinbefore, it is important that during the copying operation, especially always, the surface of the amorphous silicon type photosensitive material should be maintaind at a temperature of 30° to 40° C., especially 35° to 40° C., according to the present invention. By the term "always" used herein, it is meant that the surface of the photosensitive material is maintained at the above-mentioned temperature not only while the main switch of the copying machine is turned on but also while the main switch is turned off, for example, in the night.

The above-mentioned phenomenon of adsorption of water molecules in the atmosphere by the water molecule adsorbing medium on the surface of the photosensitive layer is the adsorption-desorption phenomenon which depends on the temperature, and within the above-mentioned temperature range, at which the desorption state can be maintained. At too low a temperature, adsorption of water molecules by the water molecule adsorbing medium takes place and the flow of an image is caused. On the other hand, at too high a temperature, migration of charges is generally increased and retention of the charges becomes difficult, resulting in reduction of the image density.

In the electrophotographic apparatus of the present invention, optional means can be adopted as a mechanism for heating the surface of the photosensitive material, so far as the surface temperature is maintained within the above-mentioned range. For example, there can be adopted a method in which a heat source is arranged in the vicinity of the surface of the photosensitive material or within the photosensitive material, or a method in which hot air is fed to the surface of the photosensitive material from a heat fixation mechanism or the like.

Adjustment of the surface temperature of the photosensitive material may be accomplished by using a known temperature-adjusting member such as a thermostat.

A known amorphous silicon type photoconductor layer may optionally be used in the present invention. For example, amorphous silicon precipitated on a substrate by plasma decomposition of a silane gas may be used. This amorphous silicon may be doped with hydrogen or halogen or with an element of the group III or IV of the Periodic Table, such as boron or phosphorus.

Typical values of the physical properties of an amorphous silicon photosensitive material are a dark conductivity not higher than $10^{-12}\Omega^{-1}\cdot cm$, an activating energy lower than 0.85 eV, a photoconductivity higher than $10^{-7}\Omega^{-1}\cdot cm^{-1}$ and an optical band gap of 1.7 to 1.9 eV. Furthermore, the amount of the bonded hydrogen is 10 to 20 atomic % and the dielectric constant of the film is in the range of from 11.5 to 12.5.

This amorphous silicon photoconductive layer can be positively or negatively charged according to the kind of the dopant, and the voltage applied to a corona charger is ordinarily in the range of from 5 to 8 KV.

In the apparatus of the present invention, optional means known in the field of electrostatic photography may be adopted as mechanism for the operations of charging, imagewise exposure, development and transfer.

As pointed out hereinbefore, in the electrophotographic apparatus of the present invention, the defect inherent to the use of an amorphous silicon type photoconductive layer can be eliminated by very simple means of heating the surface of the photosensitive material without adopting troublesome means such as the surface treatment of the photosensitive material.

The electrophotographic apparatus of the present invention may be applied to not only a copying machine but also a non-impact printer such as a CRT printer or laser printer or a laser facsimile.

The entire structure of a copying machine, to which the present invention is applied, is diagrammatically illustrated in FIG. 1.

Referring to FIG. 1, an amorphous silicon type photoconductor layer 2 is arranged on the surface of a metal drum 1 driven and rotated. On the circumference of the drum 1, there are arranged a main charging corona charger 3, an imagewise exposure mechanism comprising a lamp 4, an original-supporting transparent plate 5 and an optical system 6, a developing mechanism 8 having a toner 7, a toner transfer corona charger 9, a paper-separating corona charger 10, an electricity-removing lamp 11 and a cleaning mechanism 12 in the recited order.

At first, the photoconductor layer 2 is charged with charges of a predetermined polarity by the corona charger 3. Then, an original 13 to be copied is illuminated by a lamp 4, and the photoconductive layer 2 is exposed to a light image of the original through the optical system 6 to form an electrostatic latent image corresponding to the image of the original. This electrostatic latent image is developed with the toner 7 by the development mechanism 8. A transfer sheet 14 is supplied so that the transfer sheet 14 falls in contact with the surface of the drum at the position of the toner transfer charger 9, and corona charging of the same polarity as that of the electrostatic latent image is performed from the back face of the transfer sheet 14 to transfer the toner image to the transfer sheet 14. The transfer sheet 14 having the toner image transferred thereon is electrostatically peeled from the drum by the electricity-removing action of the paper-separating corona charger 10 and is fed to a heat fixation device 13.

This heat fixation device 15 is, for example, an oven heater having heaters 16 installed therein, and heat fixation is accomplished by heat radiation by the heaters 16.

The photoconductor layer 2, from which the toner image has been transferred, is exposed to light in front of the electricity-removing lamp 11 to erase the residual charges, and then, the residual toner is removed by the cleaning mechanism 12.

In the embodiment illustrated in FIG. 1, a heater is arranged within the photosensitive drum 1 as the heating mechanism for heating the photoconductive layer 2. This heating mechanism will now be described in detail with reference to FIGS. 2 and 3.

Both the side faces of the drum 28 (1 in FIG. 1) are closed by flanges 21 and 21' having central openings 20 and 20', and a gear portion 22 is arranged on the circumferential end edge of one flange 21 to transmit the driving power from a driving motor to the drum 28. The rotation shaft 23 of the drum is not caused to participate directly in rotation and driving, but a heater 24 may be arranged as the heating mechanism at the position of the shaft 23 to heat the interior of the drum 28 and maintain the photosensitive layer 2 at a predetermined temperature.

The flanges 21 and 21' are attached to both the side faces of the durm 1 by a plurality of rod members 25 having male screws on both the ends. The central portions of the flanges 21 and 21' have shapes including projections 26 and 26' outwardly projected and openings 20 and 20' formed at the centers thereof. A gear portion 22 is arranged on the circumferential end edge of one flange 21 to transmit the driving power of a driving motor (not shown) of the copying machine to the drum 28.

When the photosensitive drum 28 having the above-mentioned structure is attached to the copying machine, the projections 26 and 26' are fitted in bearings 27 and 27' and the drum 28 is held on a drum receiver (not shown). At this point, the gear portion 22 is engaged with a driving gear of the copying machine, so that the photosensitive drum 28 is rotatably set at the copying machine.

Attachment of the heating mechanism will now be described. Since the above-mentioned openings 20 and 20' are formed on the photosensitive drum 28 set at the copying machine and the driving power is transmitted through the gear 22 of the flange 21, the axis connecting the openings 20 and 20' to each other, that is, the rotation shaft per se, does not participate in the rotation of the drum 28. A heat source, for example, a rod heater 24, is inserted from one of the openings 20 and 20' and is secured by heater electrode sockets 30 and 30' attached to the copying machine so that a voltage can be applied to the heater 24 from a power source 31. In this embodiment of the present invention, a hollow pipe 32 or the like may be laid out between both the flanges 21 and 21' so as to facilitate the insertion of the heater 24.

Instead of the above-mentioned heater 24, a Nichrome wire insulatingly covered on a thin stainless steel plate or a so-called film heater comprising a heating member sandwiched between two insulating films may be arranged within the photosensitive drum 28.

Figure 4A:
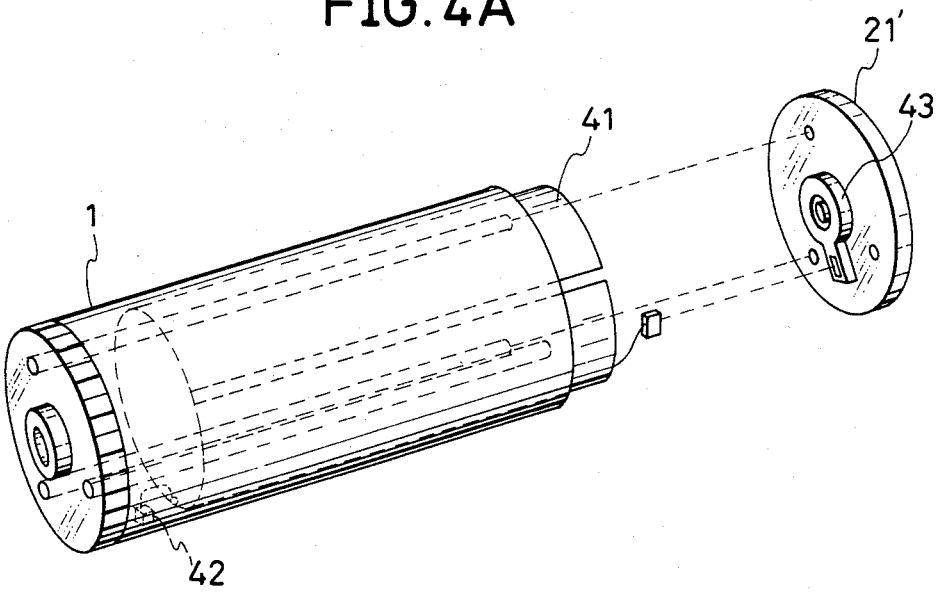
FIG. 4-A is a perspective view showing an embodiment of the present invention in which a film heater is arranged as a heating mechanism on the inner surface of a photosensitive drum.
Figure 4B:
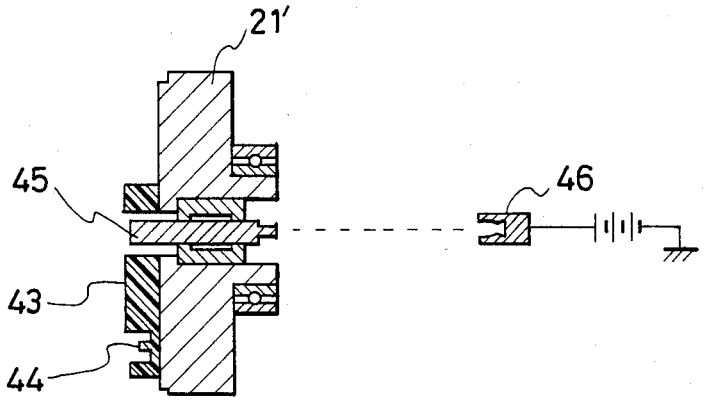

This embodiment using the film heater will now be described with reference to FIG. 4-A and FIG. 4-B showing the section of the flange 21'. The film heater 41 is inserted in the drum 1 and attached to the inner face of drum 1. One electrode 42 is connected to the inner face of the drum 1 as the ground while the other electrode is connected to a connector 44 of a rotary brush electrode 43 arranged on the inner face side of the drum 1 on one flange 21' (composed of an insulating material such as Duracon). When a heater voltage is applied from an external socket 46 through a fixed axial electrode 45, the voltage can be applied to the heater through the brush electrode 43 with rotation of the drum 1.

Referring to FIG. 3 again, control of the temperature of the photosensitive layer 2 heated by the heating mechanism is performed by a temperature-adjusting mechanism 47 described below. Namely, a temperature sensor 33 is attached in the vicinity of the surface of the photosensitive layer, and a control portion 34 for setting a predetermined temperature on receipt of a signal of the sensor 33 turns on or off a switch 35 of a heater circuit.

Figure 5:
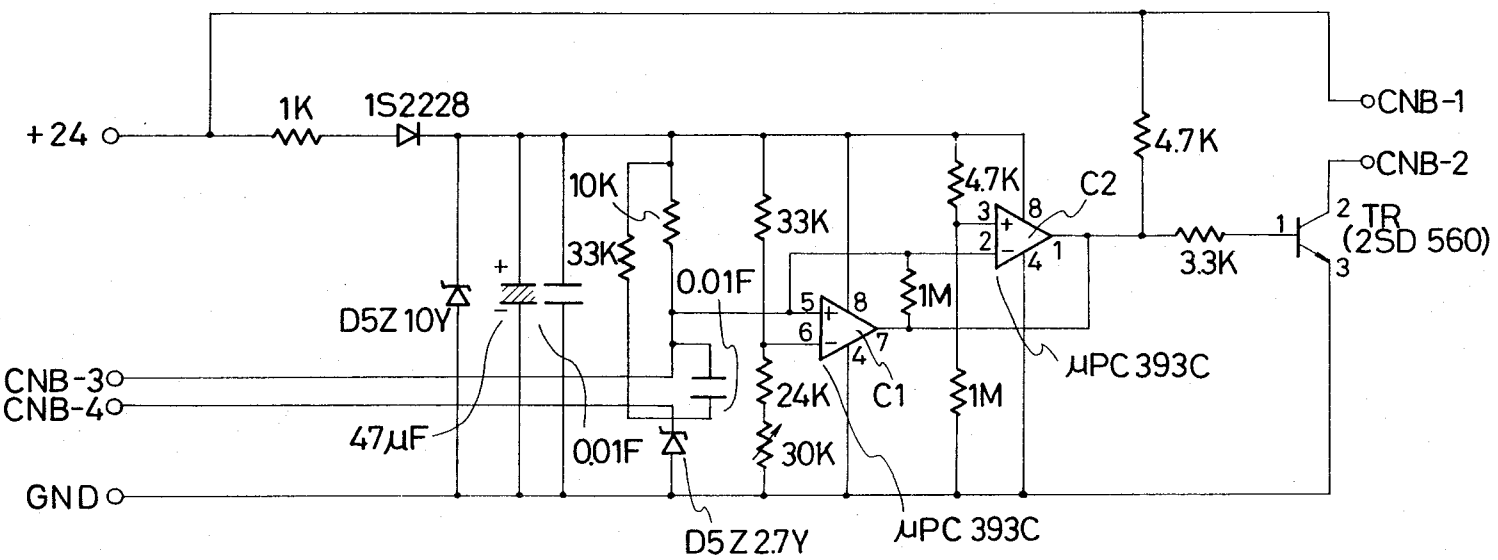
FIG. 5 is a circuit diagram illustrating an example of a temperature control circuit of a heating mechanism according to the present invention.

An example of this temperature control circuit will now be described with reference to FIG. 5. In this circuit, a thermistor is arranged as temperature detecting means, and the output voltage to the heater is adjusted to 24 V. In principle, the heater is turned on or off by controlling the base current of a transistor Tr connected in series to heater terminals CNB-1 and CNB-2.

Control of the base current is performed by two comparators C1 and C2. One comparator C1 controls the base current of the transistor Tr based on the change of the electric resistance of the thermistor caused according to the change of the surface temperature of the drum. The other comparator C2 has a protecting function of controlling the base current of the transistor Tr so as to turn off the heater when breaking is caused in the thermistor.

The comparator C1 compares the standard level on the negative side with the change of the voltage caused by the change of the resistance of the thermistor connected to the thermistor terminals CNB-3 and CNB-4 on the positive side, and based on the result of the comparison of both the levels, the comparator C1 is held at a low or high level. In the case where the surface temperature of the drum is lowered and the resistance of the thermistor is increased, the level on the positive side is higher than the standard level on the negative side and the comparator C1 is held at a high level, with the result that the base current of the transistor Tr flows and the heater is kept in the "on" state. On the other hand, in the case where the surface temperature of the drum is higher than the predetermined level, the resistance of the thermistor is excessively lowered and the voltage on the positive side is lower than the standard level (on the negative side), with the result that the comparator is held at a low level. Accordingly, the base current of the transistor Tr does not flow and the heater is kept in the "off" state.

In the comparator C1, a variable resistor is connected to the standard level (the negative side) so that the standard level can be changed to adjust the temperature.

The comparator C2 acts as a protecting circuit, and a relatively high standard level is maintained on the positive side. In the case where breaking is caused in the thermistor and detection of the temperature become impossible, the level of the positive side of the comparator C1 is higher than the standard level and the comparator C1 is held at a high level, but the level of the negative side of the comparator C2 is higher than the standard level on the positive side and hence, the comparator C2 is held at a low level. Since the base current of the transistor Tr does not flow if one of the comparators C1 and C2 is held at a low level, the base current of the transistor Tr does not flow in this case and the heater is turned off.

Figure 6:
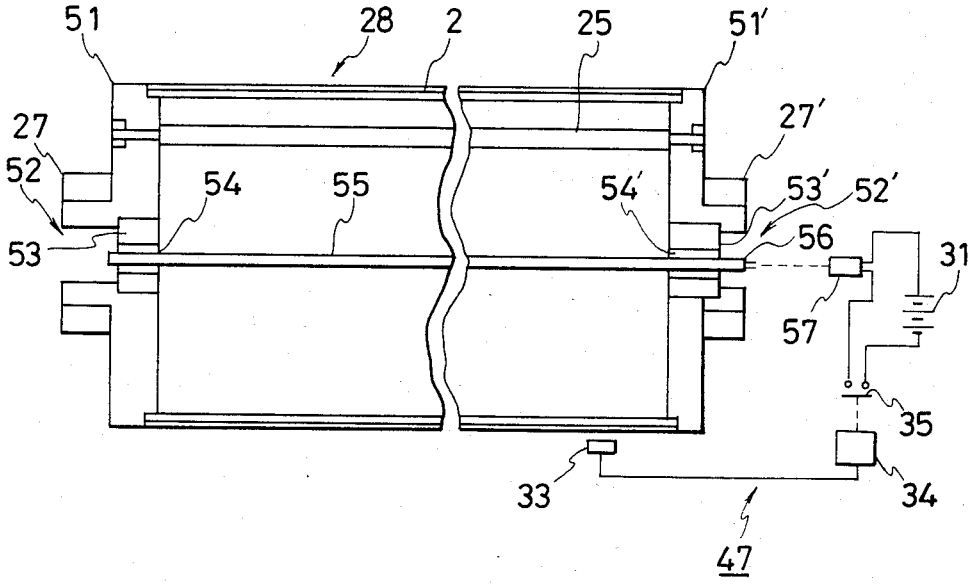
FIG. 6 is a sectional view of a photosensitive drum, which illustrates an embodiment of attachment of a heater shown in FIG. 7.

According to another embodiment of the attachment of the heating mechanism, as shown in FIG. 6, bearings 53 and 53' are fitted in openings 52 and 52' of flanges 51 and 51', and a heater 55 is attached to the central holes of the bearings through fixing members 54 and 54'. In this embodiment, the heater 55 is attached to the copying machine before the photosensitive drum 28 is set at the copying machine. In this embodiment, each of the numbers of the electrode and socket of the heater may be reduced to one (56 and 57 in the drawings), and connection to the power source 31 is facilitated.

In this embodiment, the heat source for heating the photoconductive layer 2 is disposed independently from the heat fixation mechanism, and even in the case where the photosensitive drum 28 is stopped, the photoconductive layer 2 can be uniformly heated. Therefore, even in the state where the operation of the copying machine is stopped, that is, in the case where the copying machine is not used in the night, the surface temperature of the photoconductive layer can be maintained at a level of 30° to 40° C., especially 35° to 40° C.

In the electrophotographic apparatus of the present invention, in order to completely prevent occurrence of the flow of an image, it is preferred that even in the state where the apparatus is not used, for example, in the night, the surface temperature of the photoconductive layer 2 be maintained at a level of 30° to 40° C. However, even when the apparatus is kept at room temperature in the night, if the drum is heated at the start of the operation of the apparatus, the flow of an image can be prevented. In this case, however, a certain time is necessary for stabilization for elevating the surface temperature of the photoconductive layer to the above-mentioned level.

An embodiment where the photoconductive layer is heated only while the copying machine is used will now be described with reference to FIG. 7. In this embodiment, hot air is fed into the interior space of the drum from the heat fixation mechanism 15 to heat the photoconductive layer 2.

Figure 7:
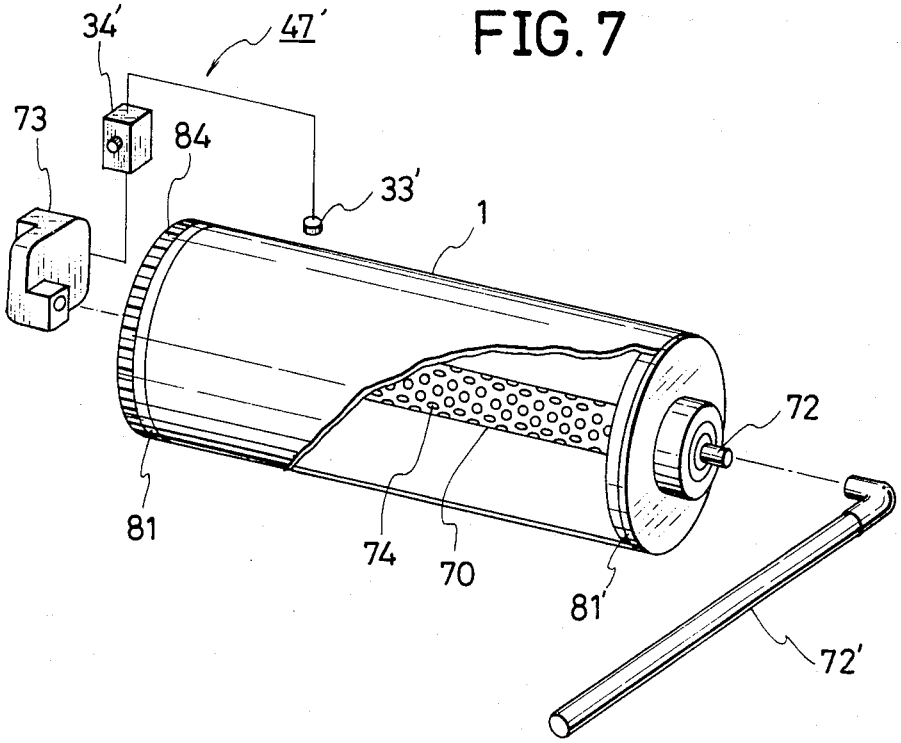
FIG. 7 is a perspective view showing an embodiment of a heating mechanism according to the present invention.
Figure 8:
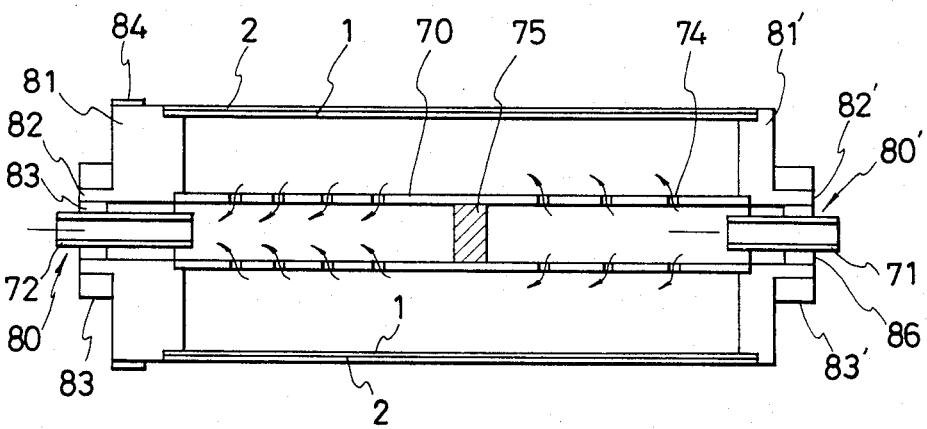
FIG. 8 is a sectional view of a photosensitive drum provided with the heating mechanism shown in FIG. 2.

Referring to FIGS. 7 and 8 illustrating this heating mechanism in detail, a hollow shaft 70 is arranged to extend through the central portion of the drum 1, and hot air is supplied into this shaft 70 from the heat fixation mechanism 15 to heat the photoconductive layer 2 from the substrate side.

More specifically, one end of the hollow shaft 70 is connected to the heat fixation mechanism 15 through air feed pipes 71 and 71', and the other end of the hollow shaft 70 is connected to an exhaust fan 73 through an air supply pipe 72. Many small holes 74 are formed on this hollow shaft 70. A rubber plug 75 is arranged in the hollow portion of the shaft 70 to divide the hollow portion into two parts.

When the exhaust fan 73 is operated, hot air is introduced into the hollow shaft 70 from the heat fixation system 15 and is filled in the interior space of the drum 1 through the small holes 74. Then, this hot air is passed through the hollow shaft 70 via the small holes 74 and discharged outside the copying machine by the exhaust fan 73. In this manner, the photoconductive layer 2 is heated by hot air from the heat fixation system 15, whereby the flow of an image is prevented.

In this embodiment, in order to arrange the hollow shaft 70 to extend through the interior of the drum, flanges 81 and 81' having central openings 80 and 80' are disposed on both the sides of the drum 1, and the openings 80 and 80' are formed to have shapes including projections 82 and 82' projected outwardly. The projections 82 and 82' are fitted in bearings 83 and 83' and the drum 1 is supported in a drum-receiving portion (not shown) of the copying machine. In this structure, the driving power for drum 1 is transmitted from a driving motor (not shown) through a gear 84 mounted on one flange 81 arranged on one side of the drum 1, whereby the drum 1 is rotated.

In this embodiment, as is apparent from the foregoing description, the drum 1 has a closed structure except the openings 80 and 81'. Accordingly, outer air is prevented from flowing into the interior space of the drum 1, and heating of the photoconductive layer 2 by hot air is effectively performed. Moreover, supply of hot air from the heat fixation mechanism 15 can be accomplished very easily.

Both the end portions of the hollow shaft 70 are connected to the inner sides of the flanges 81 and 81' so that the openings 80 and 80' of the flanges 81 and 81' are covered with both the end portions of the hollow shaft 70, and the air feed pipes 71 and 72 are directed to the interior space of the hollow shaft 70 through the openings 80 and 80'. The air feed pipes 71 and 72 are secured to the flanges 81 and 81' through the bearings 85 and 86. Accordingly, although the hollow shaft 70 is rotated together with the drum 1 when the drum 1 is driven and rotated, the air feed pipes 71 and 72 are kept stationary.

In this embodiment, since the heat fixation mechanism 15 is used as the heat source, an independent heat source need not particularly be disposed, and hot air is not supplied to the photoconductive layer 2 from the outside but hot air is supplied to the interior of the drum to heat the photoconductive layer 2. Accordingly, heating can be performed very efficiently without any bad influence being given by air streams.

It is preferred that this heating by hot air be continuously conducted, but heating may be performed intermittently, so far as the surface temperature of the photoconductive layer 2 is maintained at a level of 30° to 40° C., especially 35° to 40° C.

Control of the surface temperature of the photoconductive layer 2 is performed by a temperature-adjusting mechanism 47'. This temperature-adjusting mechanism 47' is principally the same as the above-mentioned temperature-adjusting mechanism. Namely, the temperature-adjusting mechanism 47' comprises a temperature sensor 33' arranged on the surface of the photoconductive layer 2 and a controller 34'. When the surface temperature of the photoconductive layer 2 is elevated beyond a predetermined level, the operation of the exhaust fan 73 is stopped instead of turn-off of the heater. When the surface temperature of the photoconductive layer 2 is lowered below the predetermined level, the exhaust fan 73 is operated again. Thus, the surface temperature of the photoconductive layer is adjusted to the predetermined level.

Figure 9:
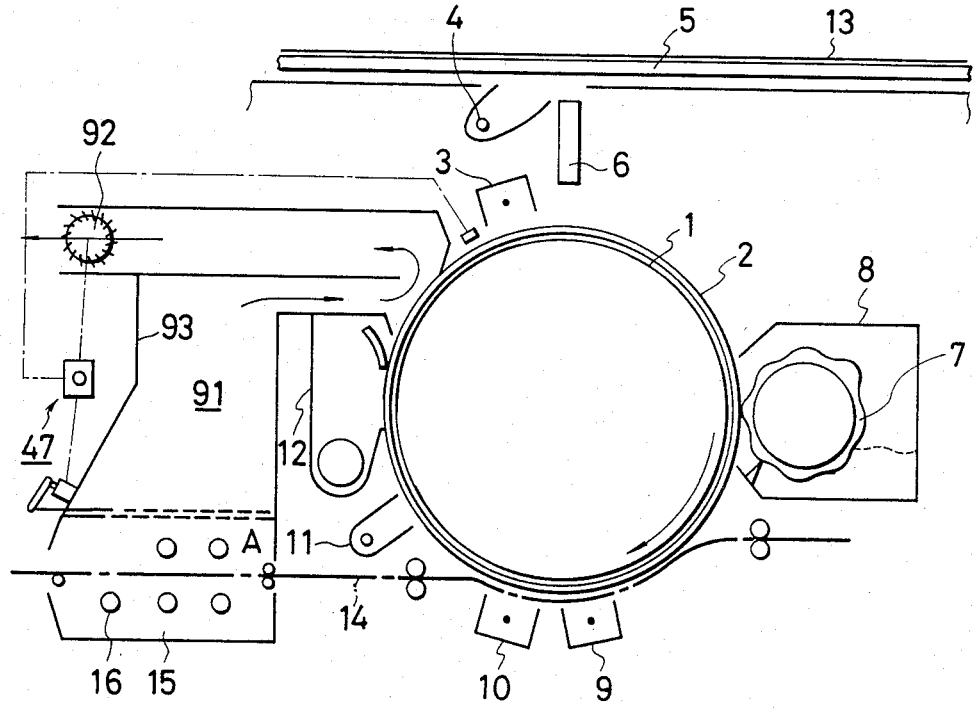
FIG. 9 is a diagram illustrating the entire structure of a copying machine to which another embodiment of the heating mechanism according to the present invention is applied.

Referring to FIG. 9 illustrating another embodiment where heating is effected while the copying machine is used and hot air is fed from the heat fixation mechanism 15 to the surface of the photoconductive layer 2 to heat the surface of the photoconductive layer 2, a hot air feed mechanism 91 comprises, for example, a fan 92 arranged to feed hot air to the surface of the photoconductive layer 2 through a passage 93. If the drum 1 is idly rotated when hot air is fed, hot air is fed to the surface of the photoconductive layer 2 by the fan 92 to effect heating of the photoconductive layer 2.

More specifically, in this embodiment, the surface of the photoconductive layer 2 is locally exposed to a part of the passage 93 connected to a heat fixation zone A of the heat fixation mechanism 15, so that when hot air passes through this passage 93, the photoconductive layer 2 is heated. The position of the exposure of the photoconductive layer 2 to the passage 93 is not particularly critical but optional, so far as the position is not limited by the space in the copying machine. However, in view of the heating efficiency, it is preferred that the photoconductive layer 2 be exposed to the passage 93 in the vicinity of the heat fixation mechanism 15. In order to prevent supplied hot air from diffusing into the copying machine through this exposed portion, it is preferred that the wall of the passage 93 on the downstream side with respect to the rotation direction of the drum 1 be arranged to abut lightly to the surface of the photoconductive layer 2. Hot air from the heat fixation zone passes through the surface portion of the photoconductive layer 2 exposed within the passage 93 and is then discharged outside the copying machine by the fan 92.

Figure 2:
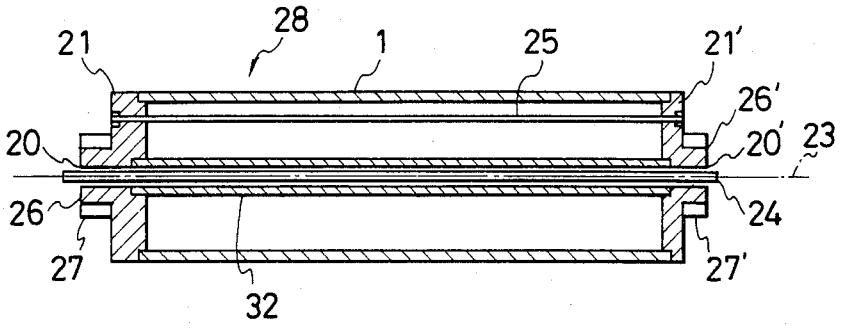
FIG. 2 is a sectional view illustrating an embodiment of the present invention in which a heater is arranged as a heating mechanism in the central portion of a photosensitive drum.
Figure 3:
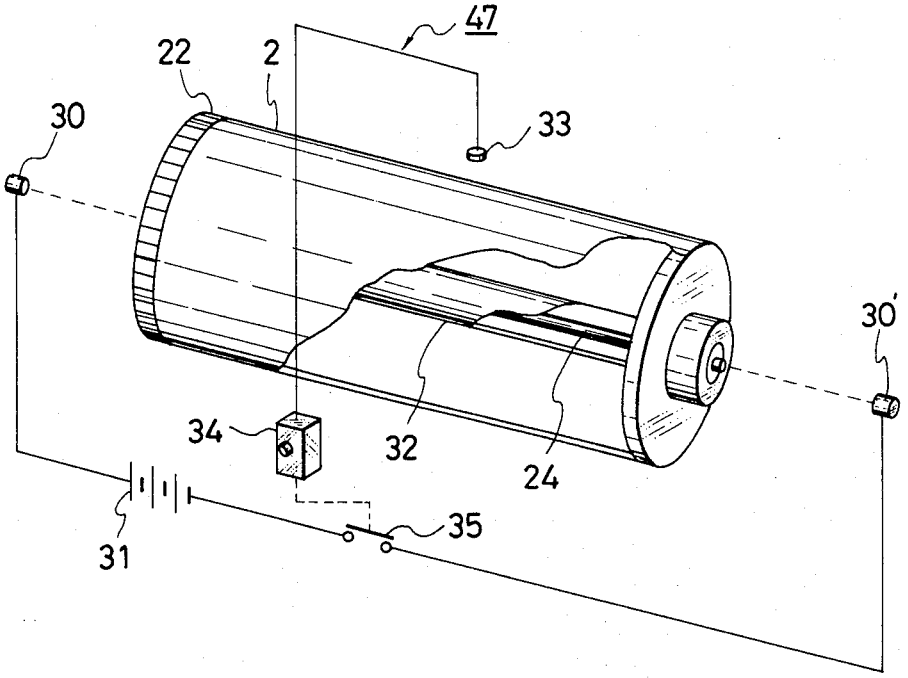
FIG. 3 is a perspective view illustrating the embodiment shown in FIG. 2.

Control of the surface temperature of the photoconductive layer 2 is accomplished by means of a temperature control mechanism 47 similar to that adopted in the embodiment shown in FIGS. 1 through 3. More specifically, when the surface temperature of the photoconductive layer 2 exceeds 40° C., the operation of the fan 92 is stopped by this control mechanism 47 to perform the temperature adjustment.

Figure 10:
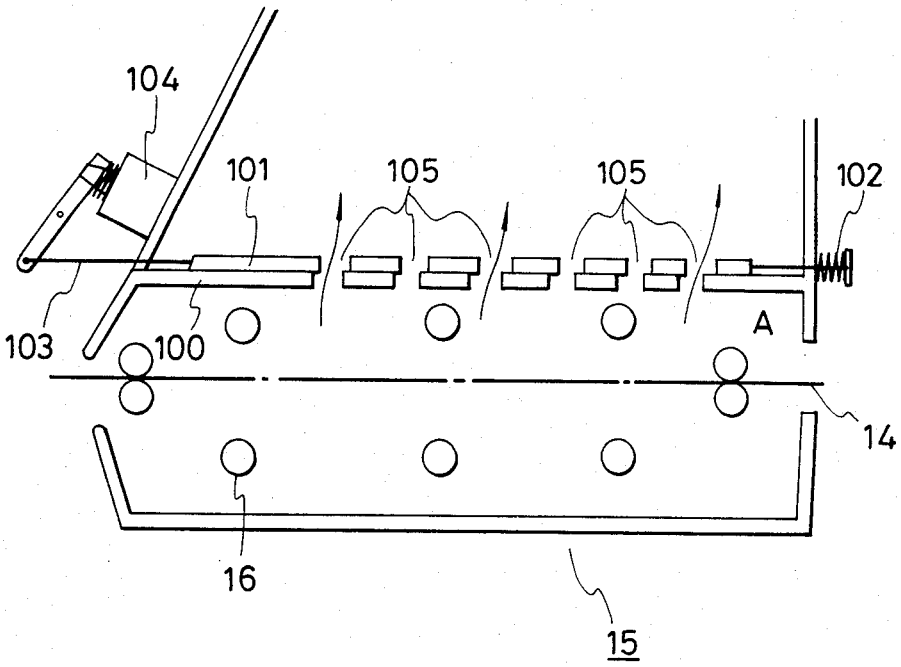
FIG. 10 is a sectional partial view illustrating the heating mechanism shown in FIG. 9.

In this embodiment, in the case where the passage 93 is always connected to the heat fixation zone A, when an oven heater is used as the heat fixation mechanism 15 as shown in FIG. 9, the ambient temperature of the fixation mechanism 15 is lowered, and hence, it is apprehended that bad influences will be imposed on the fixing operation. Accordingly, in this case, as shown in FIG. 10, a double-wall structure is given to the heat fixation mechanism 15 and one wall is slidably arranged. Namely, when hot air is fed, one wall is slid to form an opening.

In the embodiment illustrated in FIG. 10, the ceiling wall of the heat fixation mechanism 15 comprises a fixed wall 100 and a slidable wall 101, and the slidable wall 101 is set at a predetermined position by a spring 102. One end of the slidable wall 101 is connected to a solenoid 104 through a wire 103, and the wall 101 is slid by the operation of the solenoid 104 to form an opening 105. When the operation of the solenoid 104 is stopped, the slidable wall 101 is returned to the predetermined position by the spring 102 to shut the opening 105. Accordingly, a driving circuit is formed so that the solenoid 104 is operated synchronously with the fan 98. Accordingly, while hot air is not supplied, the heat fixation zone A is intercepted from the passage 93, and the heat loss is prevented.

Figure 11:
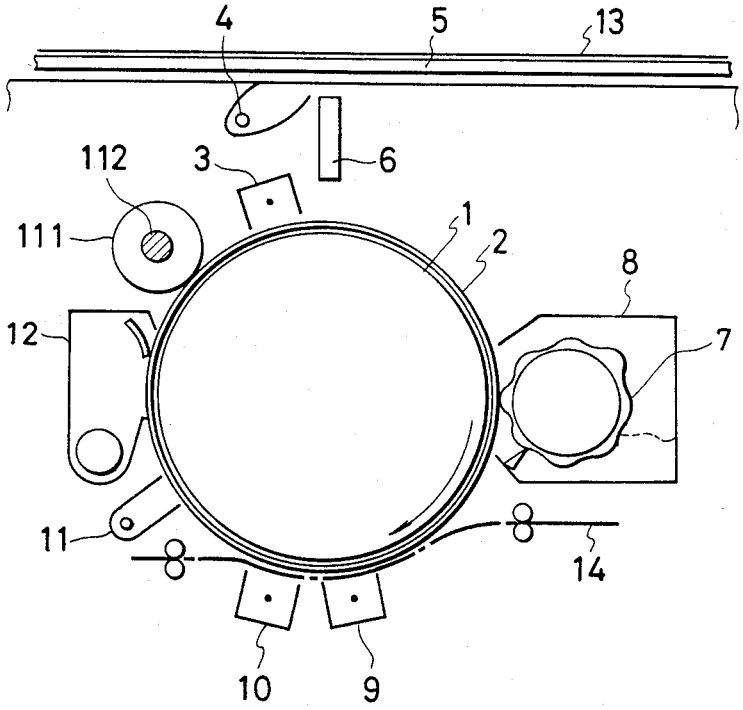
FIG. 11 is a schematic diagram illustrating an embodiment in which a hot roller is used as a heating mechanism.

In the present invention, heating of the photoconductive layer 2 can also be accomplished by using a hot roller. The structure of the copying machine comprising this heating mechanism is illustrated in FIG. 11. Referring to FIG. 11, a hot roller 111 is arranged between a cleaning mechanism 12 and a main charging corona charger 3. During the copying operation, the hot roller 111 is kept in contact with the photoconductive layer 2 to effect heating of the surface of the photoconductive layer 2. For example, a silicone rubber roller having a heater 102 installed therein may be used as the hot roller 111, and a temperature control mechanism (not shown) similar to that adopted in the foregoing embodiments is disposed to perform the temperature control by turning on or off the heater 102 according to the surface temperature of the photoconductive layer 2.

In order to prevent deformation of the roller surface or other trouble, it is preferred that the hot roller 111 be kept in the state non-contacted with the photoconductive layer 2 while the copying operation is not performed and the drum 1 is stopped. Contact or non-contact of the hot roller 111 with the photoconductive layer 2 can easily be accomplished by using such means as a cam mechanism or solenoid mechanism (not shown).

In the present invention, the heating mechanism as described hereinbefore is arranged so that the surface temperature of the photoconductive layer 2 be maintained at a level of 30° to 40° C. In the present invention, it is preferred that an interception mechanism be disposed to intercept the transfer corona charger 9 and the paper-separating corona charger 10 from the photoconductive layer 2 after termination of the copying operation.

The problem of the flow of an image is substantially solved by arranging the heating mechanism described hereinbefore, However, it sometimes happens that this problem is not completely solved only by disposition of the heating mechanism. More specifically, as shown in the Examples given hereinafter, it sometimes happens that the flow is caused in a formed image, especially at the position above the paper-separating corona charger 10. The reason has not been precisely elucidated, but it is believed that ions such as $(H_2O)_nH^+$, $O_3$ and $CO_3^-$ are generated in the atmosphere in the corona charger 10 by AC charging and since this corona charger 10 is arranged below the photosensitive drum 1, these ions rise from the corona charger 10 and adhere to the photoconductive layer 2 to cause the flow of an image.

This problem of the flow of an image caused by the above-mentioned ions can be solved by intercepting the corona charger 10 from the photoconductive layer 2 after termination of the copying operation.

Figure 12:
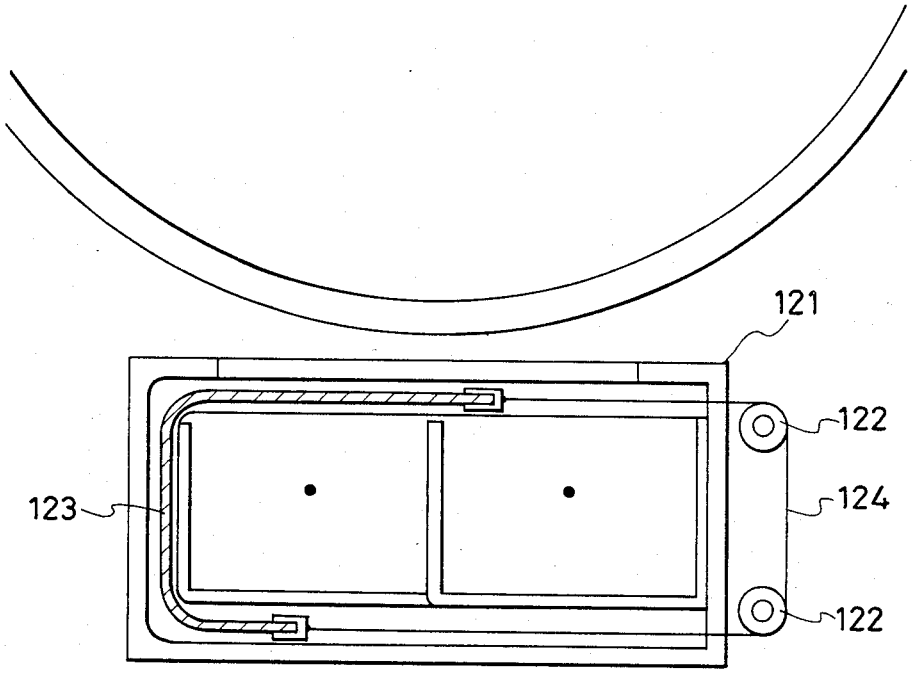
FIG. 12 is a sectional view illustrating an intercepting mechanism for a charger unit.

Interception of the corona charger 10 from the photoconductive layer 2 can be accomplished by various methods. An embodiment of this intercepting mechanism is illustrated in FIG. 12. Referring to FIG. 12, pulleys 122 are arranged around a charger unit 121 containing the charger 10 therein, and a wire 124 connected to an insulating film 123 is spread on the pulleys 122, so that the position of the insulating film 123 may be appropriately adjusted by rotating the pulleys 122. After termination of the copying operation, the pulleys 122 are rotated to cover the opening of the charger unit 121 by this intercepting film 123.

This intercepting operation is carried out after the copying machine has been continuously used, and when the copying machine is used again, this interception is released.

Of course, this interception may also be applied to the transfer corona charger 9. This transfer corona charger 9 effects charging of the same polarity as the charging polarity of the corona charger 3 for charging the photosensitive material, that is, positive charging. Although the quantities of the above-mentioned ions generated by this positive charging are small, since the transfer charger 9 is located below the photosensitive material, it is apprehended that these ions will be likely to stay in the transfer charger 9. Therefore, it is preferred that also the transfer charger 9 be intercepted from the photoconductive layer.

Furthermore, in order to further enhance the safety, it is preferred that also the main charging corona charger 3 be intercepted from the photoconductive layer 2, though ions are hardly stored in the corona charger 3.

As is apparent from the foregoing description, according to the present invention, the problem of the flow of an image is effectively solved in an electrophotographic apparatus comprising a photosensitive layer of an amorphous silicon type photoconductor.

The present invention will now be described with reference to the following examples.

Example 1

The process comprising charging (positive charging), light exposure and removal of electricity (AC charging) was continuously repeated 30,000 times on a photosensitive drum of a -Si:H, whereby Si—O bonds were formed on the surface of the drum. This drum was set in an ordinary copying machine, and the copying operation was continuously conducted 20 times, and then, the drum which was heated at several temperature was allowed to stand in an atmosphere maintained at a room temperature of 25° C. and a relative humidity of 75 or 85% for 10 hours at maximum. Incidentally, as shown in FIGS. 4-A and 4-B, a film heater was uniformly bonded to the inner surface of the drum, and a heating mechanism comprising a brush electrode contacted with a sliding end terminal of the drum was arranged so that a voltage could be applied to the film heater even while the drum was rotated. The film heater used comprised an insulated and covered Nichrome wire arranged meanderingly at certain intervals on substantially all of one surface of a thin stainless steel substrate and a cotton cloth bonded to the surface of the Nichrome wire. After the above standing for 10 hours at maximum, the copying operation was continuously conducted at each ambient temperature of drum.

The relation between the ambient temperature and standing time of the drum surface and occurrence of the flow of an image at the above continuous copying operation is shown in Table 1.

TABLE 1

| Ambient Temperature of Drum | Standing Time (hours) | Flow of Image Relative Humidity at Standing 75% | 85% |
|---|---|---|---|
| 25° C. | 1 | X | X |
| 28° C. | 1 | X | X |
| 30° C. | 1 | | Δ |
| " | 5 | | Δ |
| " | 10 | | |
| 32° C. | 1 | | Δ |
| " | 5 | | |
| " | 10 | | |
| 35° C. | 1 | | |
| " | 5 | | |
| " | 10 | | |
| 40° C. | 10 | | |
| 45° C. | 10 | | |

Note
X: the flow of an image was caused
Δ: slight bleeding of printing letters
: no bleeding of printing letters and no flow of the image

Example 2

The copying operation was continuously conducted 100 times in an atmosphere maintained at a room temperature of 25° C. and a relative humidity of 75% by using an a-Si:H drum where Si—O bonds were formed as in Example 1 while changing the ambient temperature of the drum by using the heating mechanism shown in FIGS. 2 and 3. If the ambient temperature of the drum was lower than 30° C., the flow of an image was caused when scores of prints were formed, but if the ambient temperature of the drum was at least 30° C., the flow of an image was not caused during the continuous copying operation.

Figure 13:
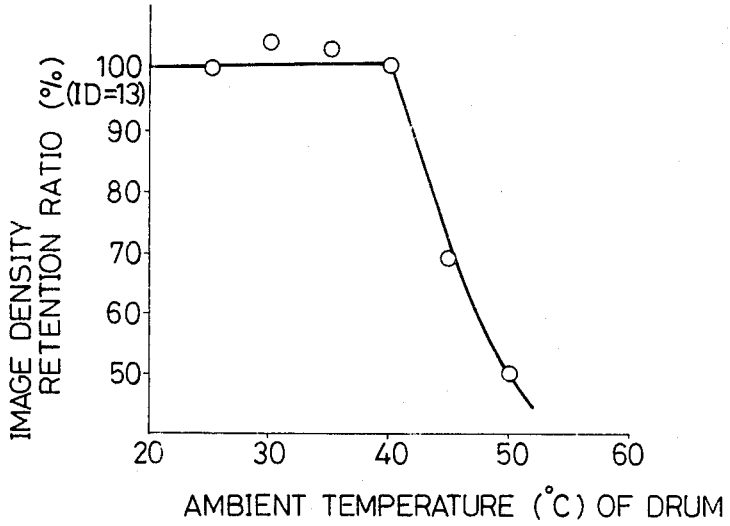
FIG. 13 is a graph illustrating the relation between the ambient temperature of a photosensitive drum and the image density retention ratio.

If the ambient temperature of the drum exceeded 40° C., because of the inherent characteristic of the semiconductor, the dark resistivity was reduced and the image density was reduced in the prints. However, also in this case, the flow of an image was not caused. The relation between the ambient temperature of the drum and the image density retention ratio is shown in FIG. 13. Incidentally, the retention ratio in the drawings is a percent value calculated based on the assumption that the reflection density of the image area (solid black portion of 2 cm ×2 cm) measured by a reflection densitometer (Model TC-6D supplied by Tokyo Denshoku), which was 1.3, was 100%.

From the results obtained in Examples 1 and 2, it was confirmed that if the temperature of the vicinity of the surface of the photosensitive material is adjusted to 30° to 40° C., stable images having a high density can be obtained without the flow of an image, and especially, if the temperature of the vicinity of the surface of the photosensitive material is adjusted to 35° to 40° C., even under such a high humidity condition as a relative humidity of 85%, bleeding of printed letters is not caused at all and very stable images can be obtained.

We claim:

1. An electrophotographic apparatus comprising a photosensitive drum comprising an amorphous silicon type photoconductor layer formed on an electroconductive substrate, a main charging mechanism for charging the surface of the drum with charges having a predetermined polarity, an imagewise exposure mechanism for forming an electrostatic image corresponding to an image of an original on the surface of the drum, a toner development mechanism for forming a toner image corresponding to the electrostatic image, a toner image transfer mechanism for transferring the toner image formed on the surface of the photosensitive drum to a predetermined paper sheet, a toner cleaning mechanism for removing the residual toner adhering to the surface of the photosensitive drum and a fixing mechanism for fixing the transferred toner image to said paper sheet, wherein a heating mechanism is arranged to heat the surface of the photosensitive drum and is connected to a temperature-adjusting mechanism for detecting the surface temperature of said drum and adjusting and maintaining said surface temperature at a temperature of 30° to 40° C.

2. An electrophotographic apparatus as set forth in claim 1, wherein the heating mechanism is connected to a temperature-adjusting mechanism for heating the surface of the photosensitive drum at 35° to 40° C. and adjusting the surface temperature of the photosensitive drum within said range.

3. An electrophotographic apparatus as set forth in claim 1 wherein the fixing mechanism is a heat fixation mechanism and the heating mechanism feeds hot air to the photosensitive drum from the heat fixation mechanism to effect heating of the surface of the photosensitive drum.

4. An electrophotographic apparatus as set forth in claim 3, wherein a driving powertransmitting member is arranged on the circumferential end edge on one side of the photosensitive drum to transmit driving power from a driving motor to said drum and drive and rotate said drum, said heating mechanism comprises a hollow shaft arranged to extend longitudinally through the hollow space of said photosensitive drum substantially at the center thereof and an airflow producing means with one end of said shaft connected to the heat fixation zone and the other end connected to said airflow producing means, a plurality of small holes are formed in the circumferential surface of said hollow shaft and the interior of said shaft is divided into two parts.

5. An electrophotographic apparatus as set forth in claim 3, wherein the heating mechanism feeds hot air from the heat fixation mechanism to the surface of the photosensitive drum.

6. An electrophotographic apparatus as set forth in claim 1 wherein the heating mechanism is a heater arranged in the interior of the photosensitive drum.

7. An electrophotographic apparatus as set forth in claim 1, wherein the heating mechanism is a hot roller arranged in the vicinity of the surface of the photosensitive drum.

8. An electrophotographic apparatus as set forth in claim 1 wherein, at the time of termination of the copying operation, the toner image transfer mechanism is intercepted from the amorphous silicon type photoconductive layer.

9. An electrophotographic apparatus as set forth in claim 1, wherein a transfer sheet-separating electricity-removing mechanism is arranged adjacently to the toner image transfer mechanism, and at the time of termination of the copying operation, the toner image transfer mechanism and/or the electricity-removing mechanism is intercepted from the amorphous silicon type photoconductive layer.

10. An electrophotographic apparatus as set forth in claim 6, wherein the heater arranged in the interior of the photosensitive drum is a film heater attached to the inner wall of the photosensitive drum.

11. An electrophotographic apparatus as set forth in claim 6, wherein the heater arranged in the interior of the photosensitive drum is a rod heater located on the rotation shaft of the photosensitive drum.

12. An electrophotographic apparatus as set forth in claim 1, wherein said temperature adjusting mechanism comprises a temperature sensor attached in proximity to the surface of said photosensitive drum and a control means for setting a predetermined temperature upon receipt of a signal from said sensor so as to maintain said drum surface at a temperature of 30° to 40° C.

13. An electrophotographic apparatus as set forth in claim 4, wherein activation of said airflow producing means draws hot air from said heat fixation zone into said shaft, dividing means within said shaft causes the hot air to be drawn through a first group of said holes on one side of said dividing means into the interior of said drum to heat the photosensitive surface from inside, the air then being drawn back into said shaft through a second group of said holes on the other side of said dividing means and exhausted through said airflow producing means.

14. An electrophotographic apparatus as set forth in claim 8, wherein interception of said toner image transfer mechanism is by means of an insulating film connected to pulleys by means of a wire such that rotation of said pulleys causes said film to move to cover or uncover said toner image transfer mechanism.

15. An electrophotographic apparatus as in claim 8, wherein intercepting of the toner image transfer mechanism from the photoconductive layer prevents the flow of ions between said mechanism and said layer.

16. An electrophotographic apparatus as in claim 5, wherein said heating mechanism incorporates a solenoid operated sliding wall in conjunction with said heat fixation mechanism to intercept the heat fixation zone from said heating mechanism, thereby preventing undue heat loss in said heat fixation zone, said sliding wall being operated synchronously with a fan which draws the hot air to the surface of the photosensitive drum such that said wall is closed when said fan is off.

* * * * *